US007474283B2

(12) United States Patent
Fish

(10) Patent No.: US 7,474,283 B2
(45) Date of Patent: Jan. 6, 2009

(54) ELECTROLUMINESCENT DISPLAY DEVICES

(75) Inventor: David A. Fish, Haywards Heath (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 552 days.

(21) Appl. No.: 10/562,886

(22) PCT Filed: Jun. 23, 2004

(86) PCT No.: PCT/IB2004/002118

§ 371 (c)(1),
(2), (4) Date: Dec. 29, 2005

(87) PCT Pub. No.: WO2005/004097

PCT Pub. Date: Jan. 13, 2005

(65) Prior Publication Data

US 2006/0164344 A1 Jul. 27, 2006

(30) Foreign Application Priority Data

Jul. 2, 2003 (GB) ..... 0315455.6

(51) Int. Cl.
*G09G 3/30* (2006.01)

(52) U.S. Cl. ..... 345/76; 313/463

(58) Field of Classification Search ..... 345/76–83; 313/463

See application file for complete search history.

(56) References Cited

U.S. PATENT DOCUMENTS

| | | | |
|---|---|---|---|
| 6,489,631 B2 | 12/2002 | Young et al. | |
| 2001/0052597 A1 | 12/2001 | Young et al. | |
| 2001/0055008 A1 | 12/2001 | Young et al. | |
| 2002/0044123 A1 | 4/2002 | Aoki | |

FOREIGN PATENT DOCUMENTS

| | | | |
|---|---|---|---|
| EP | 0717446 A2 | | 6/1996 |
| EP | 1096466 A1 | | 5/2001 |
| JP | 2002297095 A | * | 1/2002 |
| JP | 2004198683 A | * | 7/2004 |
| WO | 9636959 A2 | | 11/1996 |
| WO | 0120591 A1 | | 3/2001 |
| WO | 0199190 A2 | | 12/2001 |
| WO | 0199191 A1 | | 12/2001 |

* cited by examiner

*Primary Examiner*—Amare Mengistu
*Assistant Examiner*—Vinh T Lam
(74) *Attorney, Agent, or Firm*—Michael E. Belk

(57) ABSTRACT

In an active matrix electroluminescent display device a storage capacitor (24) is provided in each pixel (10) for storing a voltage to be used for addressing a drive transistor (22) which controls the illumination of the electroluminescent display element (20) and gated discharge photosensitive means (36), for example a phototransistor, are provided for discharging the charge storage capacitor in dependence on the display element's light output. Operation of the gated photosensitive means is controlled by the output of an inverter (50) whose input is coupled to one side of the storage capacitor. Upon the storage capacitor reaching a predetermined discharge voltage, the gated photosensitive means (36) is turned on by switching of the inverter, thereby rapidly discharging the capacitor and turning off the display element. The use of an inverter in this way ensures a fast, robust, and well controlled switching action to terminate light output.

13 Claims, 4 Drawing Sheets

ELECTROLUMINESCENT DISPLAY DEVICES

This invention relates to electroluminescent display devices, particularly active matrix display devices having an array of pixels comprising light-emitting electroluminescent display elements and thin film transistors. More particularly, the invention is concerned with an active matrix electroluminescent display device whose pixels include light sensing elements which are responsive to light emitted by the display elements and used to control energisation of the display elements.

Matrix display devices employing electroluminescent, light-emitting, display elements are well known. The display elements commonly comprise organic thin film electroluminescent elements, (OLEDs), including polymer materials (PLEDs), or else light emitting diodes (LEDs). These materials typically comprise one or more layers of a semiconducting conjugated polymer sandwiched between a pair of electrodes, one of which is transparent and the other of which is of a material suitable for injecting holes or electrons into the polymer layer.

The display elements in such display devices are current driven and a conventional, analogue, drive scheme involves supplying a controllable current to the display element. Typically a current source transistor is provided as part of the pixel configuration, with the gate voltage supplied to the current source transistor determining the current through the electroluminescent (EL) display element. A storage capacitor holds the gate voltage after the addressing phase. An example of such a pixel circuit is described in EP-A-0717446.

Each pixel thus comprises the EL display element and associated driver circuitry. The driver circuitry has an address transistor which is turned on by a row address pulse on a row conductor. When the address transistor is turned on, a data voltage on a column conductor can pass to the remainder of the pixel. In particular, the address transistor supplies the column conductor voltage to the current source, comprising the drive transistor and the storage capacitor connected to the gate of the drive transistor. The column, data, voltage is provided to the gate of the drive transistor and the gate is held at this voltage by the storage capacitor even after the row address pulse has ended. The drive transistor in this circuit is implemented as a p-channel TFT, (Thin Film Transistor) so that the storage capacitor holds the gate-source voltage fixed. This results in a fixed source-drain current through the transistor, which therefore provides the desired current source operation of the pixel.

In the above basic pixel circuit, differential ageing, or degradation, of the LED material leading to a reduction in the light output level of a pixel for a given drive current can give rise to variations in image quality across a display. Also, display non-uniformity problems can arise due to the variability in the characteristics of the drive transistors, particularly the threshold voltage level.

Improved voltage-addressed pixel circuits which can compensate for the ageing of the LED material and variation in transistor characteristics have been proposed. These include a light sensing element which is responsive to the light output of the display element and acts to leak stored charge on the storage capacitor in response to the light output, so as to control the integrated light output of the display element during the drive period which follows the initial addressing of the pixel. Examples of this type of pixel configuration are described in detail in WO 01/20591 and EP 1 096 466. In an example embodiment, a photodiode in the pixel discharges the gate voltage stored on the storage capacitor and the EL display element ceases to emit when the gate voltage on the drive transistor reaches the threshold voltage, at which time the storage capacitor stops discharging. The rate at which charge is leaked from the photodiode is a function of the display element output, so that the photodiode serves as a light-sensitive feedback device.

With this arrangement, the light output from a display element independent of the EL display element efficiency and ageing compensation is thereby provided. Such a technique has been shown to be effective in achieving a high quality display which suffers less from non-uniformities over a period of time. However, for good results a high efficiency photodiode such as an amorphous silicon pin photodiode is preferably used which causes manufacturing complications where polycrystalline silicon TFTs are used as the drive transistors, as is typically the case. Also, to achieve good frame time average brightness from a pixel, a high peak brightness level is required which means that the EL element is used away from the most efficient operation point, with the result that the LED material is likely to age more rapidly.

In aforementioned WO 01/20591 and EP-A-1096466 embodiments of pixel circuits are described that use a lower efficiency photo-transistor as the light sensing element which can easily be fabricated together with the drive TFTs using common processes. In these pixel circuits the light falling on the photo-transistor leads to gradual discharging of the storage capacitor and a consequential fall in the current through the drive transistor and when the current drops to a predetermined low level the photo-transistor is turned on to rapidly discharge the capacitor. This turn on is accomplished by connecting the gate of the photo-transistor to the anode of the EL element. However, a problem with this is that significant movement in the EL element anode voltage is required which can be difficult to achieve. Also, in this pixel circuit the connection to the EL element anode means that an effect of LED ageing, namely an increase in the anode voltage, is coupled back into the pixel circuit, and there may be pixel circuit non-uniformity due to variations in the parameters of the drive transistor and the photo-transistor.

It is an object of the present invention to provide an improved active matrix electroluminescent display device of the kind using optical feedback in the pixel circuits.

According to one aspect of the invention, there is provided an active matrix electroluminescent display device comprising an array of display pixels, each pixel comprising:

an electroluminescent display element;

a drive transistor for driving a current through the display element;

a storage capacitor for storing a voltage to be used for addressing the drive transistor;

gated photosensitive means coupled to the storage capacitor for discharging the storage capacitor in dependence on the light output of the display element;

and an inverter whose output is coupled to the gate of the gated photosensitive means and whose input is coupled to one side of the storage capacitor, the inverter being operable to turn on the gated photosensitive means rapidly to discharge the storage capacitor upon the voltage at the one side of the storage capacitor reaching a predetermined level.

In this device, therefore, the gate of the gated photosensitive means is no longer connected to the anode of the EL element. Instead the voltage of the gate is controlled by the inverter in dependence on the storage capacitor voltage. This leads to significant improvements in the performance of the display device and the quality of display produced. In particular, the effects of variations in the threshold levels of the pixel drive transistors, leading to non-uniformity problems, are avoided. Also, a dependence in the operation of the known pixel circuit on the threshold voltage of the EL element, which increases with the age of the EL element, is avoided. The pixel circuits of the device of the invention operate in a similar manner to the known pixel circuits in providing a "snap-off" action whereby light output from the EL element is rapidly terminated upon the gated photosensitive means being turned on. However, the "snap-off" action achieved by the pixels of the invention is improved compared with that which is obtained using simply a photo-transistor as in the known pixel circuit, and a significantly more robust, and faster, switching action is achieved.

The gated photosensitive means may be a phototransistor, preferably a TFT structure, or a lateral gated photodiode device. The means may alternatively comprise a combination of elements, such as an NIP or PIN photodiode connected in parallel with a standard TFT.

Preferably, as in conventional pixel circuits, the drive transistor is connected between a power supply line and the display element. The gated photosensitive means may then be connected in parallel with the storage capacitor between the power supply line and the gate of the drive transistor.

Also as in conventional devices, each pixel may include an address transistor connected between an input signal line, for example carrying an analogue voltage data signal, and a pixel input coupled to a node between the one side of the storage capacitor and the gate of the drive transistor.

The power line supply line may be utilized for convenience as one voltage supply for the inverter, the other voltage supply being provided by a reference potential source, e.g. ground line.

Preferably, the inverter is a CMOS type inverter, as such an inverter only uses current when it switches. An inverter using TFTs of both conductivity types (p and n) may though introduce some non-uniformity due to variations in the characteristics of the TFTs of different inverters if simply connected between the one side of the storage capacitor and the gate of the photosensitive means.

In a preferred embodiment, therefore, each pixel includes a further capacitor connected between the input of the inverter and the one side of the storage capacitor and on which an adjustment voltage is stored that is dependent on the switching point voltage of the inverter. In this way, the action of the gated photosensitive means can be rendered independent of variations which may occur in the switching point voltage of the inverter, and such that the operation of the gated photosensitive means is controlled reliably in accordance with a certain, predetermined, voltage level being present at the one side of the storage capacitor. Each pixel preferably further includes a switching transistor connected between the input and output of the inverter which is operable during an addressing phase so as to hold the inverter at its switch point voltage.

In the case of the pixels being arranged in rows with the pixels in a row being selected in an addressing phase by a selection (gating) signal supplied via a respective row address line, as in conventional devices, the reference potential source for the inverters of a row of pixels may conveniently by provided by a row address line associated with an adjacent pixel row. In conventional drive schemes, the selection address signal for a row of pixels is applied to the associated row address conductor for a relatively short row address period, typically corresponding to the frame period divided by the number of rows of pixels in the array, and for the remainder of the frame period the row address conductor is usually held at low, fixed, potential, typically ground.

According to another aspect of the invention, there is provided an active matrix circuit for driving an array of electroluminescent display elements and comprising an array of driving circuits for driving the display elements, each driving circuit comprising:

a drive transistor providing a drive current for the display element;

a storage capacitor for storing a voltage to be used for addressing the drive transistor;

gated photosensitive means coupled to the storage capacitor for discharging the storage capacitor in accordance with light incident on the gated photosensitive means; and an inverter whose output is coupled to the gate of the gated photosensitive means and whose input is coupled to one side of the storage capacitor, the inverter being arranged to turn on the gated photosensitive means rapidly to discharge the storage capacitor upon the voltage at the one side of the storage capacitor attaining a certain discharge level in response to light incident on the gated photosensitive means.

Embodiments of active matrix electroluminescent (EL) display devices in accordance with the invention will now described, by way of example, with reference to the accompanying drawings, in which:—

The same reference numbers are used throughout the Figures to denote the same, or similar, parts.

Figure 1:
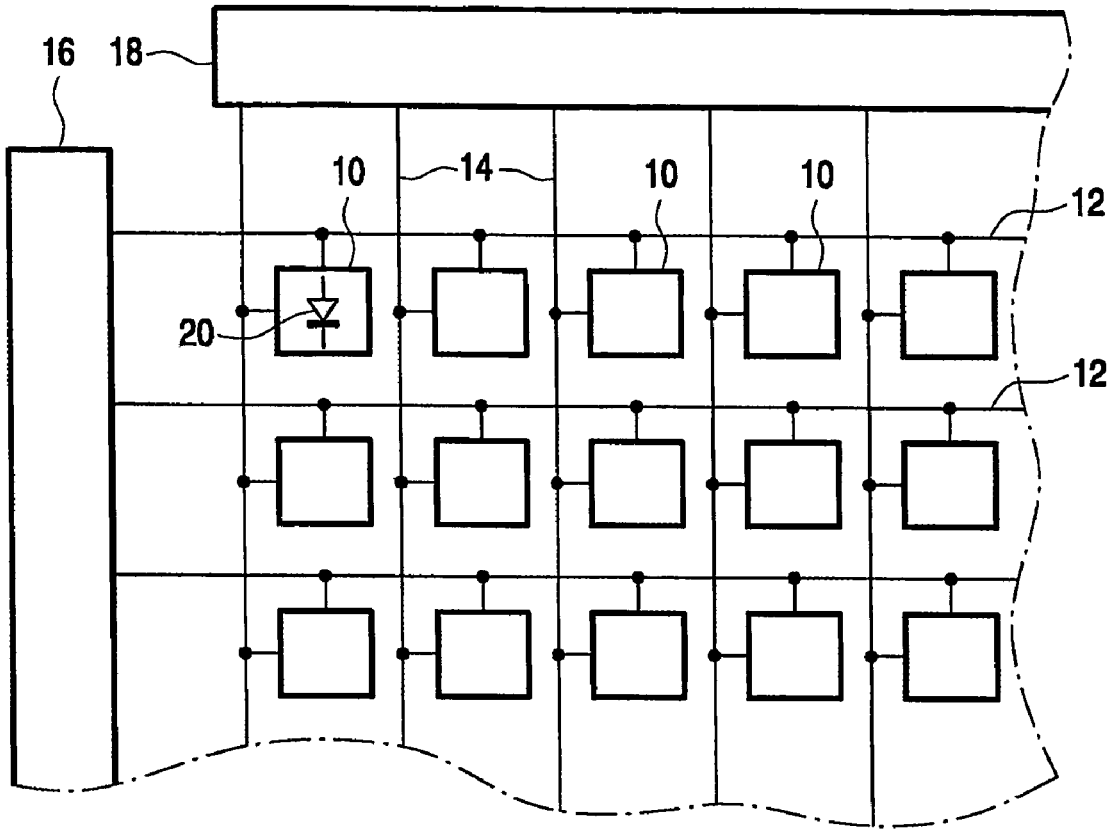
FIG. 1 is a simplified schematic diagram of an embodiment of active matrix EL display device according to the invention.

Referring to FIG. 1, the active matrix EL display device comprises a panel having a row and column matrix array of regularly-spaced pixels, denoted by the blocks 10, each comprising an EL display element 20 and an associated driving circuit controlling the current through the display element. The pixels are located at the intersections between crossing sets of row (selection) and column (data) address conductors, or lines, 12 and 14. Only a few pixels are shown here for simplicity. The pixels 10 are addressed via the sets of address conductors by a peripheral drive circuit comprising a row, scanning, driver circuit 16 and a column, data, driver circuit 18 connected to the ends of the respective conductor sets.

Each row of pixels is addressed in turn in a frame period by means of a selection pulse signal applied by the circuit 16 to the relevant row conductor 12 so as to program the pixels of the row with respective data signals which determine their individual display outputs in a frame period that follows the address period, the data signals being supplied in parallel by the circuit 18 to the column conductors 14. As each row is addressed, the data signals are supplied by the circuit 18 in appropriate synchronisation.

The EL display element 20 of each pixel comprises an organic light emitting diode, represented here as a diode element (LED), and comprising a pair of electrodes between which one or more active layers of organic electroluminescent light-emitting material are sandwiched. In this particular embodiment the material comprises a polymer LED material, although other organic electroluminescent materials, such as low molecular weight materials, could be used. The display elements of the array are carried, together with their associated active matrix circuitry, on the surface of an insulating substrate. The substrate is of transparent material, for example glass, and either the cathodes or anodes of the display elements 20 are formed of a transparent conductive material, such as ITO, so that light generated by the electroluminescent layer is transmitted through these electrodes. Typical examples of suitable organic conjugated polymer materials which can be used for the EL material are described in WO 96/36959. Typical examples of other, low molecular weight, organic materials are described in EP-A-0717446.

The driving circuit of each pixel 10 includes a drive transistor, comprising a low temperature polysilicon TFT (thin film transistor), which is responsible for controlling the current through the display element 20 on the basis of a data signal voltage applied to the pixel via a column conductor 14 which is shared by a respective column of pixels. The column conductor 14 is coupled to the gate of the current-controlling drive TFT through an address TFT in the pixel driving circuit and the gates for the address TFTs of a row pixels are all connected to a respective, common, row address conductor 12.

Although not shown in FIG. 1, each row of pixels 10 also shares, in conventional manner, a respective power supply line held at a predetermined voltage, and a reference potential line, usually provided as a continuous electrode common to all pixels. The display element 20 and the drive TFT are connected in series between the power supply line and the common reference potential line. The reference potential line, for example, may be at ground potential and the power supply line at a positive potential around, for example, 12V with respect thereto.

The features of the display device described thus far are generally similar to those of known devices.

Figure 2:
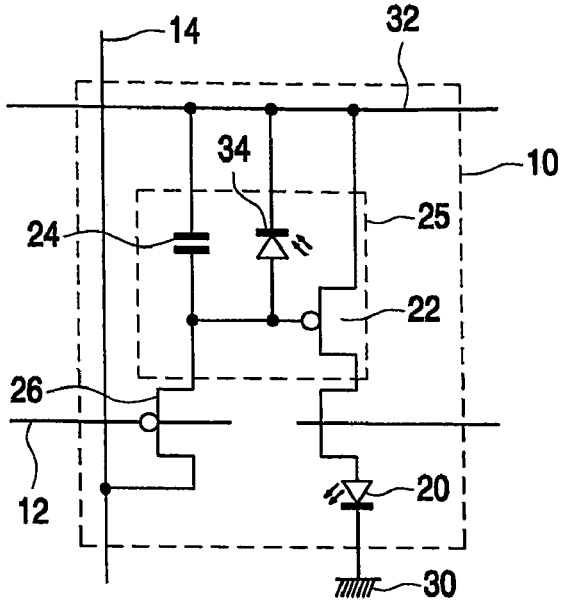
FIGS. 2 and 3 show schematically the equivalent circuits of a known forms of pixels.

FIG. 2 illustrates a known form of pixel circuit, as described in WO 01/20591 for example. Here the drive TFT and the address TFT, both comprising p-channel devices, are referenced at 22 and 26 respectively, and the power supply line and reference potential line are referenced at 32 and 30 respectively. When the address TFT 26 is turned on in a respective row address period by a selection pulse signal applied to the row conductor 12, a voltage (data signal) on the column conductor 14 can pass to the remainder of the pixel. In particular, the TFT 26 supplies the column conductor voltage to a current source circuit 25 comprising the drive TFT 22 and a storage capacitor 24 connected between the gate of the TFT 22 and the power supply line 32. Thus, the column voltage is provided to the gate of the TFT 22 which is held at this voltage, constituting a stored control value, by the storage capacitor 24 even after the address TFT 26 is turned off at the end of the row address period. The drive TFT 22 is here implemented as a P-channel TFT and the capacitor 24 holds the gate—source voltage. This results in a fixed source—drain current through the TFT 22, which therefore provides the desired current source operation of the pixel. Electrical current through the display element 20 is regulated by the drive TFT 22 and is a function of the gate voltage on the TFT 22, which is dependent upon the stored control value determined by the column voltage, data, signal. At the end of the row address period, the voltage retained by the storage capacitor 24 maintains the operation of the display element during the subsequent drive period before the pixel is addressed again in the next frame period. The voltage between the gate of the TFT 22 and the reference potential line 32 thus determines the current passing through the display element 20, and in turn controls the instantaneous light output level of the pixel.

The known pixel circuit of FIG. 2 further includes a discharge photodiode 34, which is reverse biased and responsive to light emitted by the display element 20 and acts to decay the charge stored on the storage capacitor 24 in dependence on light emitted by the element 20, via the photocurrent generated in the photodiode. The photodiode discharges the gate voltage stored on the capacitor 24 and when the gate voltage on the TFT 22 reaches the TFT's threshold voltage the display element 20 will no longer emit light and the storage capacitor stops discharging. The rate at which charge is leaked from the photodiode 34 is a function of the display element light output level so that the photodiode 34 functions as a light sensitive feedback device.

The photodiode feedback arrangement is used to compensate for the degradational effects of display element ageing, whereby the efficiency of its operation in terms of the light output level produced for a given drive current diminishes. Through such degradation display elements that have been driven longer and harder will exhibit reduced brightness, causing display non-uniformities. The photodiode arrangement counteracts these effects by appropriately controlling the integrated, total, light output from a display element in the drive period, corresponding to a frame period at maximum. The length of time for which a display element is energized to generate light during the drive period which follows the address period is regulated according to the existing drive current light emission level characteristic of the display element, as well as the level of the applied data signal, such that the effects of degradation are reduced. Degraded, dimmer, display elements will result in the pixel driving circuit energizing the display element for a period longer than that for an un-degraded, brighter, display element so that the average brightness can remain the same over an extended period of time of device operation.

The average light output in the drive period is dependent on the efficiency of the photodiode 34, which is highly uniform across the array of pixels, and is independent of the efficiency of the LED element. However, the output is dependent also on the threshold voltage of the drive TFT 22 and as this can vary from pixel to pixel display non-uniformity may occur. The pixel circuit of FIG. 2 also requires an efficient photodiode, typically an amorphous silicon pin photodiode and relatively high peak brightness to achieve reasonable average brightness. The decay of the charge stored on the storage capacitor 24 means also that the circuit operates at comparatively low brightness levels for most of the drive period. The circuit thus operates the LED at low efficiency and, therefore, can lead to increased ageing.

Figure 3:
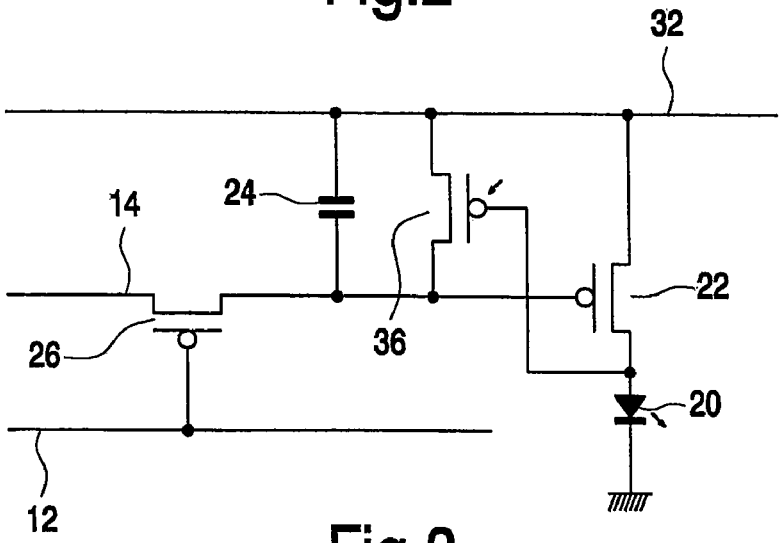

FIG. 3 illustrates another form of pixel circuit described in WO 01/20591 using optical feedback. In this circuit, the photodiode is replaced by a lower efficiency phototransistor 36 which is connected across the storage capacitor 24, between the power supply line 30 and the gate node of the drive TFT 22, and whose gate is connected to the node between the drive TFT 22 and the anode of the LED element 20. In this arrangement, the phototransistor 36, comprising a p-channel device, is used in reverse bias and photocurrent generated in response to light input from the LED 20 serves to discharge gradually the storage capacitor 24. The LED anode voltage falls in this phase of operation as the current passed by the TFT 22 decreases, and upon a certain anode voltage level being reached, corresponding to the threshold voltage level of the phototransistor 36, the phototransistor 36 is turned on, thereby discharging the remaining charge on the storage capacitor 24 and turning off the drive TFT 22. This use of a phototransistor and movement of the anode voltage, and the snap-off action achieved, helps avoid the steep current/light decay found in the pixel circuit of FIG. 2. This manner of operation enables lower efficiency photosensitive elements to be used, and permits lower peak brightness levels.

Figure 4:
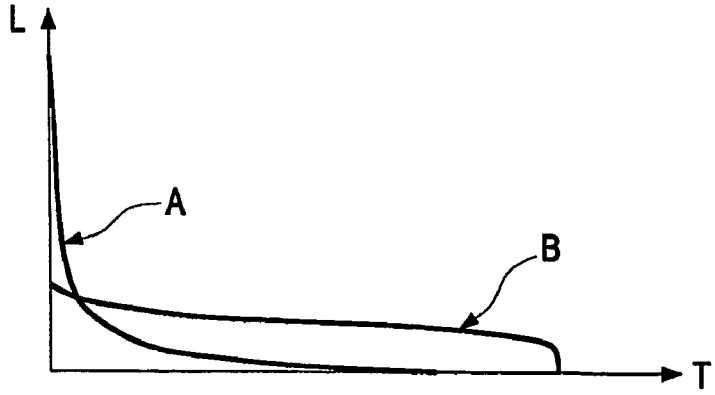
FIG. 4 illustrates graphically the operation of the pixels of FIGS. 2 and 3.

FIG. 4 illustrates graphically the differences between brightness, L, against time, T, in the case of the operation of the pixel circuit of FIG. 2, curve A, and the operation of the pixel circuit of FIG. 3, curve B.

Although the pixel circuit of FIG. 3 has advantages over the circuit of FIG. 2, certain problems can be experienced. The LED anode voltage typically will move only a few volts at most, and this limited voltage change means that the phototransistor 36 may not be turned on hard and will, therefore, likely perform poorly as a switch. This means the differential ageing compensation achieved can be compromised. In addition, the anode voltage increases in accordance with degradation of the LED element and part of this voltage is capacitively kicked back onto the storage capacitor. Hence, the connection to the anode of the LED element 20 inevitably means that an LED element ageing factor is coupled back into the circuit. Also, there may be circuit non-uniformity due to variations in the characteristics of the drive TFTs 22 and phototransistors 36 from pixel to pixel. The latter two problems can be verified by analysis of the electrical behaviour of the pixel circuit. Such analysis shows that the voltage on the storage capacitor 24 at the time at which the phototransistor 36 turns on is dependent to an extent on the threshold voltage level and mobility of the drive TFT 22, and the threshold voltage of the phototransistor 36, which lead to a non-uniformity problem, and also to an extent on the threshold voltage of the LED element, which, because it increases with ageing, introduces a differential ageing element.

These problems are overcome by using, in accordance with the invention, an inverter to control the operation of the phototransistor. This provides a much improved snap-off action than can be achieved by a phototransistor alone as in the circuit of FIG. 3.

Figure 5:
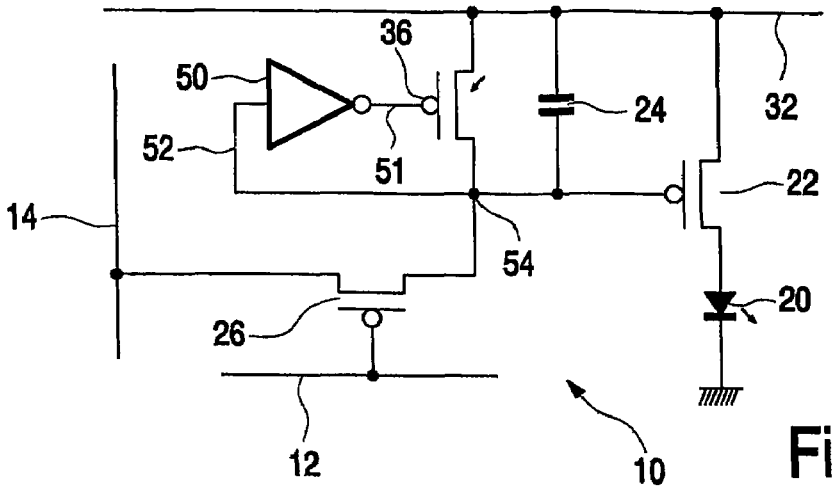
FIG. 5 shows schematically the equivalent circuit of a typical pixel in the device of FIG. 1.

FIG. 5 illustrates an embodiment of pixel circuit according to the invention. The circuit includes an inverter 50 whose output 51 is coupled to the gate of the phototransistor 36 and whose input 52 is coupled to the node 54 between the gate of the drive TFT 22, the side of the storage capacitor 24 remote from the power line 32, and one terminal of the phototransistor 36.

Operation of this circuit is generally similar to that of FIG. 3 in that a voltage dependent on a data signal applied along the line 14 is stored on the storage capacitor 24 in an address period through the address TFT 26, and the phototransistor 36 serves to leak charge from the storage capacitor 24 in a drive period following the address period as a result of light emitted from the LED element 20 in this period falling on the phototransistor 36. However, the gate of the phototransistor 36 is no longer connected to the anode of the LED element 20 and the snap-off action performed by the phototransistor 36 is instead controlled by the inverter 50. When the voltage on the storage capacitor 24, that is, the voltage on the node 54, and corresponding to the voltage on the inverter input voltage, reaches a predetermined discharge level equivalent to the switching point voltage of the inverter, the inverter output voltage will quickly switch to ground and thereby strongly turn on the phototransistor 36 to discharge completely the capacitor 24. A more robust switching action is therefore achieved compared to that of the FIG. 3 circuit as the switching action of the inverter occurs between two definite, controllable, voltages and is very rapid.

Although other kinds of inverter circuit could be used, a CMOS type inverter is preferred. Here, the p and n type transistors are provided as p and n type TFTs.

However, considering the inverter at its switch point, that is when the inverter input voltage equals its output voltage, then the currents passing through the p and n type TFTs within the inverter at this point will be equal and it can be shown by analysis of the electrical characteristics that the switch point is dependent on the threshold voltages and the mobilities of both the p and n type TFTs of the inverter. Consequently, in the simple circuit of FIG. 5 a non-uniformity problem could arise, as illustrated graphically in FIG. 6, in which the relationships between the inverter input and output voltages, Vin and Vout respectively, for three inverters with varying TFT parameters are plotted. As can be seen, the switch point, Vs, determined by the condition Vin equals Vout, can vary.

Figure 6:
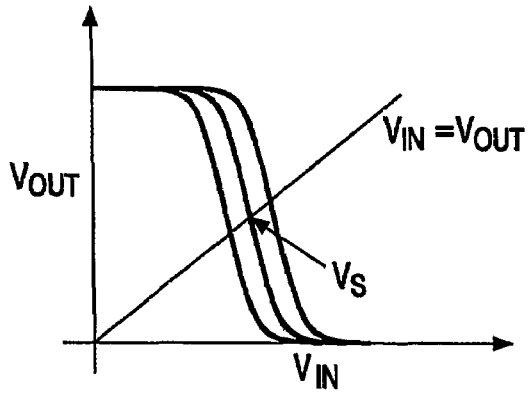
FIG. 6 is a graph showing possible variations in the operation of the pixel of FIG. 5.

In order to obtain a well-defined turn on voltage the slope of the characteristic shown in FIG. 6 should preferably be very high, and ideally vertical.

Figure 7:
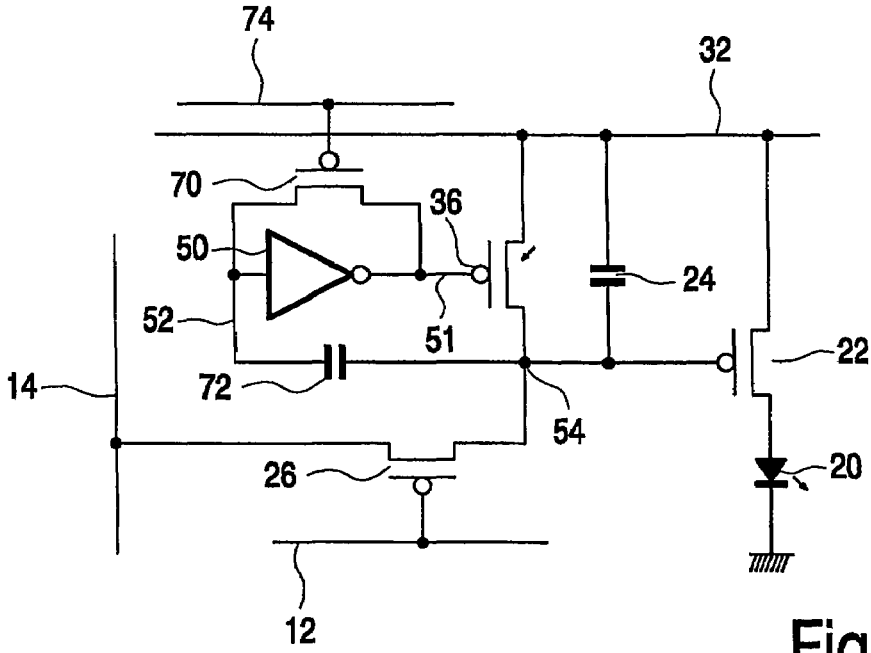
FIG. 7 illustrates another embodiment of pixel circuit in accordance with the present invention.
Figure 8:
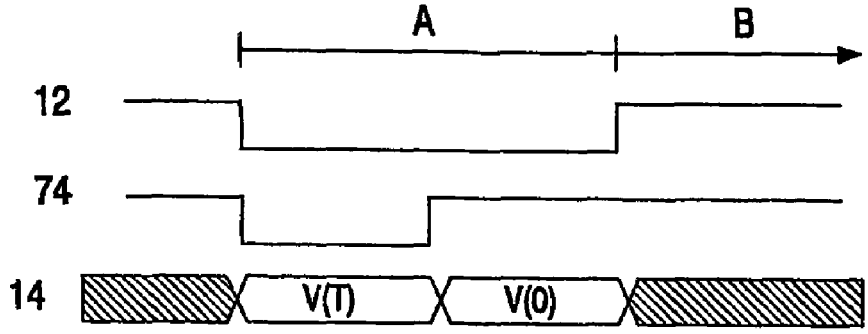
FIG. 8 illustrates various waveforms present in operation of the pixel circuit of FIG. 7.

A second embodiment of pixel circuit in accordance with the invention, which is modified so as to correct for the aforementioned variations in switch points, is illustrated in FIG. 7. FIG. 8 shows the relative timings of various addressing waveforms present in operation of this pixel circuit. This pixel circuit differs from that of FIG. 5 by further including a switch 70, comprising a further p-channel TFT, connected across the input 52 and output 51 of the inverter 50, and a capacitor 72 connected between the node 54 and the inverter input.

The operation of the TFT switch 70 is controlled by the waveform applied to its associated address line 74 and when turned on serves to hold the inverter 50 at its switch point, Vs, by making Vin equal to Vout. At the same time as the addressing TFT 26 is turned on by the application of a gating signal to address conductor 12, the data conductor 14 is held at the voltage, V(T), at which it is desired the phototransistor 36 should turn on, i.e. the voltage determining the snap-off action. This results in the capacitor 72 being charged to a voltage equivalent to Vs−V(T). The switch TFT 70 is then turned off, resulting in this charge being stored on the capacitor 72, following which the data conductor 14 is moved to the required data signal voltage level, V(O), determining a desired display output from the pixel. As V(O) is less than V(T), the input 52 to the inverter 50 will be pulled down so that the inverter output 51 will be high, corresponding to the power line 32 voltage in a practical implementation, which holds the phototransistor 36 off, as is required at this addressing phase of the pixel operation denoted by the period A in FIG. 8. At the end of the addressing phase A, the address TFT 26 is turned off and thereafter, in the drive phase B, the pixel behaves in similar manner to the previously described embodiment with the LED element 20 generating a light output and photocurrent produced in the phototransistor 36 being allowed to discharge the storage capacitor 24. If the characteristic of the inverter 50 is close to ideal, that is, the slope of the characteristic shown in FIG. 6 is at or near vertical, which can be achieved by careful design of the inverter circuit, then the output 51 of the inverter 50 will remain high until the voltage value V(T) is reached on the storage capacitor 24, at which time the inverter input 52 will be equal to Vs−V(T)+V(T), that is, Vs. Thus, the inverter changes state when the voltage on the storage capacitor 24 reaches V(T). This change in state brings the inverter output 52 to a low voltage, e.g ground, leads to the snap-off action whereby the phototransistor 36 is turned on hard to rapidly complete discharge of the storage capacitor 24, causing the LED element 20 to be turned off and light output from the pixel to be terminated.

It will be appreciated, therefore, that this pixel circuit overcomes possible non-uniformity problems as discussed above, provided that the characteristic of the inverter 50 is sufficiently sharp. Because the inverter 50 is merely required to drive the gate of another moderately sized TFT this can easily be achieved. The capacitive load will be very small so only small amounts of current will be required. Therefore, a very fast state change, typically less than one microsecond, can be obtained using relatively small size TFTs in the inverter.

Figure 9:
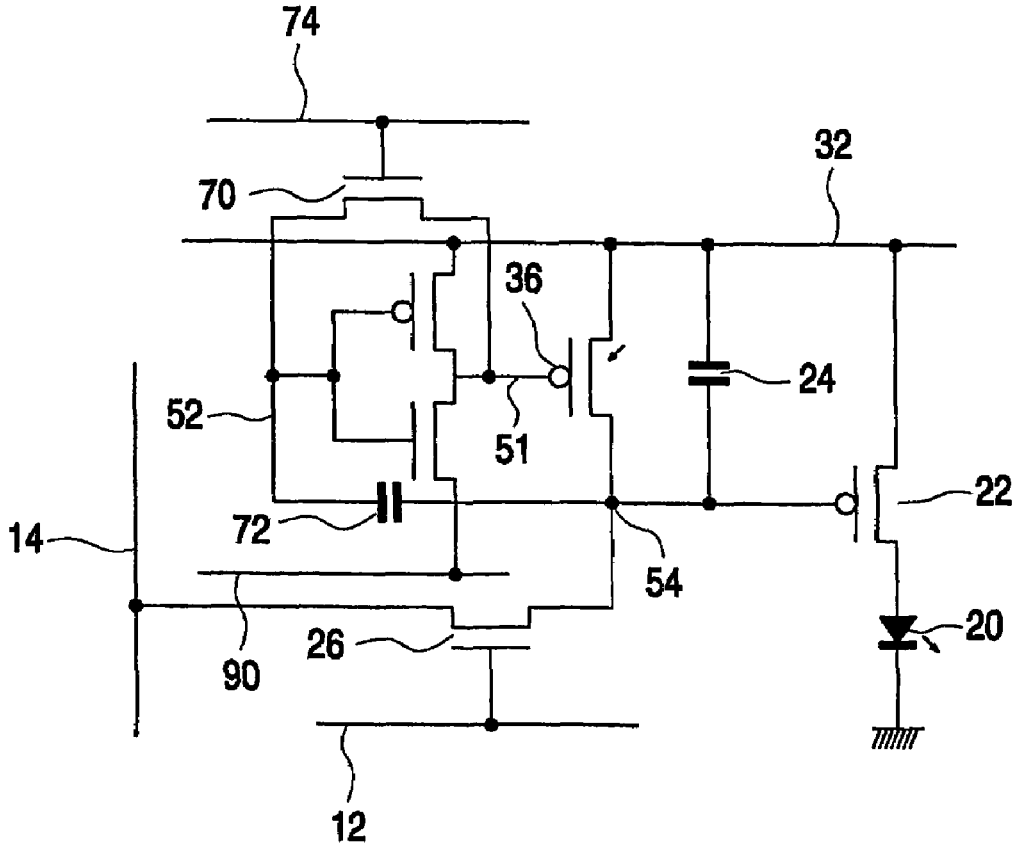
FIG. 9 illustrates a practical embodiment of the pixel circuit of FIG. 7.

FIG. 9 shows a practical implementation of the pixel circuit of FIG. 7. Here, the inverter 50 comprises a pair of TFTs of opposite conductivity type, i.e. one p type and one n type, connected in series between the power line 32, which provides the high output level that is used to hold the phototransistor 36 off, and a ground line 90, which provides the low output level that turns on the phototransistor 36.

It will be appreciated that the address lines 12 and 74, the ground line 90, and the power line 32 are shared by all pixels in the same row. Rather than using a separate, dedicated, line for the ground line 90, an address conductor 12 associated with an adjacent, previously addressed, row of pixels may be utilized instead for this purpose. For this reason, the address TFT 26 comprises an n-channel device.

While in the above—described embodiments, phototransistors are used as the photo-sensitive feedback elements, it is envisaged that other gated photosensitive devices can be used, such as, for example, lateral gated PIN devices. A combination of elements may also be used, for example a PIN or NIP photodiode connected in parallel with a TFT, the photodiode being responsive to light output from the display element to discharge the storage capacitor and the TFT being responsive to the output of the inverter.

Moreover, although these example embodiments use p-channel type TFTs as the drive TFTs 22, it is envisaged that n channel type TFTs may be used instead and references herein to discharging of the storage capacitor should, therefore, be construed accordingly in relation to the nature of the charge stored in the address phase.

From reading the present disclosure, other modifications will be apparent to persons skilled in the art. Such modifications may involve other features which are already known in the field of active matrix electroluminescent display devices and component parts therefor and which may be used instead of or in addition to features already described herein.

The invention claimed is:

1. An active matrix electroluminescent display device comprising an array of display pixels (10), each pixel comprising:

an electroluminescent display element (20);

a drive transistor (22) for driving a current through the display element;

a storage capacitor (24) for storing a voltage to be used for addressing the drive transistor;

gated photosensitive means (36) coupled to the storage capacitor (24) for discharging the storage capacitor in dependence on the light output of the display element;

and an inverter (50) whose output (51) is coupled to the gate of the gated photosensitive means (36) and whose input (52) is coupled to one side of the storage capacitor (24), the inverter being operable to turn on the gated photosensitive means rapidly to discharge the storage capacitor upon the voltage at the one side of the storage capacitor reaching a predetermined level.

2. A display device according to claim 1, wherein the drive transistor (22) is connected between a power supply line (32) and the display element (20).

3. A display device according to claim 2, wherein the gated photosensitive means (36) is connected in parallel with the storage capacitor between the power supply line (32) and the gate of the drive transistor (22).

4. A display device according to claim 3, wherein the inverter (50) comprises a pair of transistors of opposite conductivity type connected in series between first (32) and second voltage inputs (90).

5. A display device according to claim 4, wherein the power supply line (32) provides the first voltage input for the inverter.

6. A display device according to claim 4, wherein each pixel includes a further capacitor (72) connected between the input (52) of the inverter and the one side of the storage capacitor and on which an adjustment voltage is stored that is dependent on the switching point voltage of the inverter.

7. A display device according to claim 6, wherein each pixel includes a switching transistor (70) connected between the input (52) and output (51) of the inverter (50) which is operable during a pixel addressing phase so as to hold the inverter at its switch point voltage.

8. A display device according to claim 1, wherein each pixel further includes an address transistor (26) connected between an input signal line (14) and a pixel input coupled to a node (54) between the one side of the storage capacitor (24) and the gate of the drive transistor (22).

9. A display device according to claim 8, wherein the pixels (10) are arranged in rows and columns with a respective input signal line (14) being shared by a column of pixels, and wherein the address transistors (26) of the pixels in a row are connected to and controlled via a respective address conductor (12).

10. A display device according to claim 9, wherein a voltage input for the inverters (50) of the pixels in one row is provided by an address conductor (90/12) associated with an adjacent row of pixels.

11. A display device according to claim 1, wherein the gated photosensitive means comprises a phototransistor.

12. A display device according to claim 1, wherein the gated photosensitive means comprises a lateral gated photodiode device.

13. An active matrix circuit for driving an array of electroluminescent display elements (20) and comprising an array of driving circuits (10) for driving the display elements, each driving circuit comprising:

a drive transistor (22) providing a drive current for the display element;

a storage capacitor (24) for storing a voltage to be used for addressing the drive transistor (22);

gated photosensitive means (36) coupled to the storage capacitor for discharging the storage capacitor in accordance with light incident on the gated photosensitive means; and an inverter (50) whose output (51) is coupled to the gate of the gated photosensitive means (36) and whose input (52) is coupled to one side of the storage capacitor (24), the inverter being arranged to turn on the gated photosensitive means rapidly to discharge the storage capacitor upon the voltage at the one side of the storage capacitor attaining a certain discharge level in response to light incident on the gated photosensitive means.

* * * * *